United States Patent [19]

Fraioli

[11] 4,398,376

[45] Aug. 16, 1983

[54] FABRIC PANEL UNIT

[75] Inventor: Donato M. Fraioli, Mamaroneck, N.Y.

[73] Assignee: Air-Tech Industries, Inc., Clifton, N.J.

[21] Appl. No.: 794,337

[22] Filed: May 6, 1977

Related U.S. Application Data

[63] Continuation of Ser. No. 683,098, May 4, 1976, abandoned.

[51] Int. Cl.[3] ..... E04B 1/34; E04B 1/00

[52] U.S. Cl. ..... 52/2; 52/63; 52/222

[58] Field of Search ..... 9/11 A; 46/90; 52/2, 52/63, 222, 173 DS; 4/171, 177; 5/365, 351; 160/378; 135/15 LF

[56] References Cited

U.S. PATENT DOCUMENTS

| | | | |
|---|---|---|---|
| 2,360,715 | 10/1944 | Perry | 5/365 |
| 2,682,274 | 6/1954 | Miller | 52/2 |
| 2,718,014 | 9/1955 | Mizrach et al. | 4/177 |
| 2,771,899 | 11/1956 | Swallert | 52/2 X |
| 2,986,150 | 5/1961 | Torian | 135/15 CF X |
| 3,165,110 | 7/1965 | Brooks | 135/15 CF |
| 3,176,843 | 4/1965 | Hoskins et al. | 160/378 X |
| 3,366,977 | 2/1968 | Koehler | 160/354 X |
| 3,791,077 | 2/1974 | Ventimiglia | 52/2 |
| 3,899,853 | 8/1975 | Wertman | 52/2 |
| 3,941,140 | 3/1976 | Beavers | 135/15 CF |
| 3,953,955 | 5/1976 | Huddle | 52/63 X |

FOREIGN PATENT DOCUMENTS

| | | | |
|---|---|---|---|
| 838446 | 4/1970 | Canada | 52/2 |
| 2045897 | 3/1971 | Fed. Rep. of Germany | 52/2 |
| 2131112 | 12/1971 | Fed. Rep. of Germany | 52/2 |
| 2326453 | 12/1974 | Fed. Rep. of Germany | 52/2 |
| 883576 | 7/1943 | France | 160/378 |
| 1236645 | 6/1960 | France | 160/378 |

*Primary Examiner*—Leslie Braun
*Attorney, Agent, or Firm*—Darby & Darby

[57] ABSTRACT

A fabric panel unit for use as a wall of a structure in which a fabric strip is secured to the panel along the long edges of the strip to form an elongated pocket open on the ends. An inflatable tube with an inflation valve is positioned inside the pocket. The panel unit is extended between supporting structural members and anchored thereto in a relatively slack condition. The pocket extends transversely to the run of the panel between supporting structural members at opposite sides of the panel. The panel is tensioned by inflating the tube to distend the pocket and to shorten the panel in the direction of its run. Impact loading on the panel is absorbed by elongation of the cross-sectional shape of the pocket.

2 Claims, 10 Drawing Figures

WIND

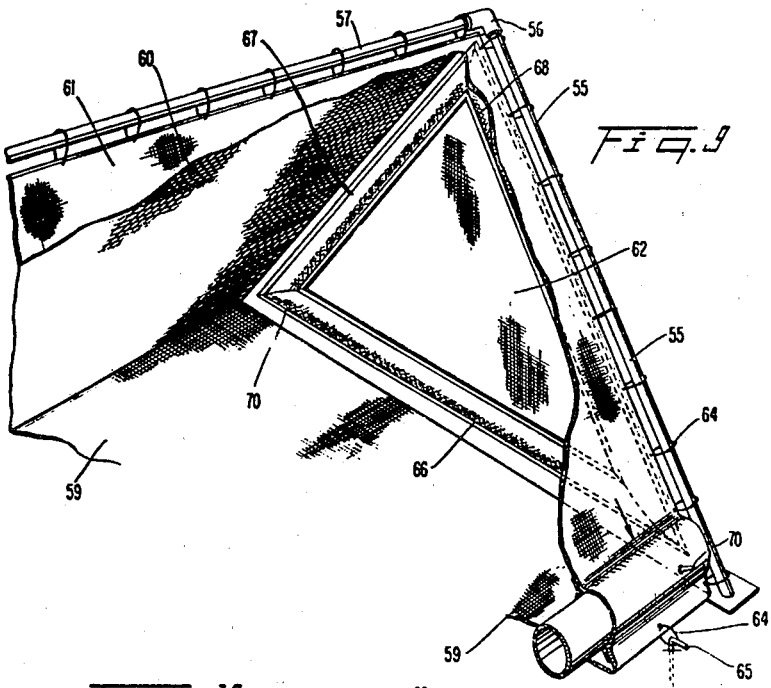
Fig. 9
Fig. 10
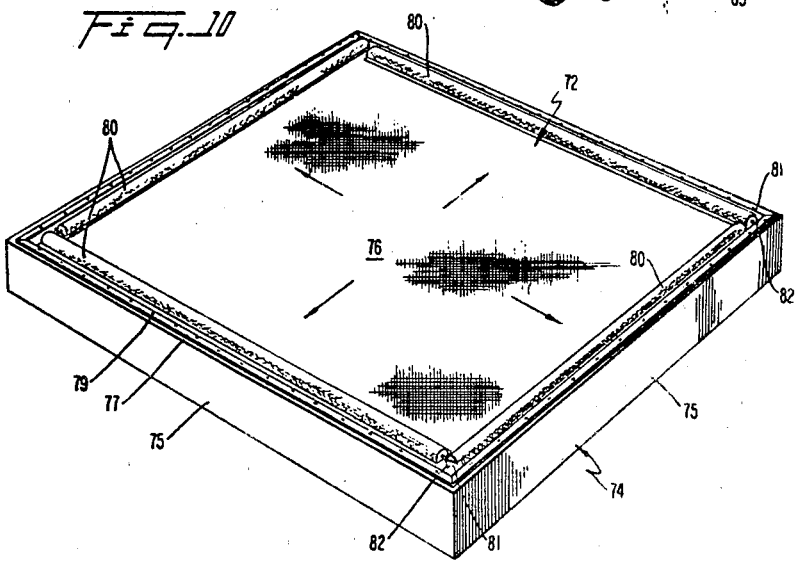

FABRIC PANEL UNIT

This application is a continuation of prior application Ser. No. 683,098, filed May 4, 1976, which application is now abandoned.

BACKGROUND OF THE INVENTION

The present invention relates to methods of producing tension within sheets of flexible materials which are supported by structural members of some sort. The present invention also relates to methods of absorbing impact loading upon tensioned sheets of flexible materials.

Fabric materials have long been used in conjunction with framework elements to provide temporary shelters of a utilitarian type. Such structures suffer to a degree from unsightly appearance due to sagging and wrinkled walls and from flapping caused by insufficiently tensioned panels. In erecting frame supported fabric structures of conventional construction, each panel which extends between a pair of spaced structural support points must be tensioned as it is put into place. In order for the installed panel to be reasonably taut, the fabric is secured to the support points on one edge of the panel and the panel is stretched toward the support points at the opposite edge of the panel. Tensioning of the panel during its installation is frequently an extremely difficult and awkward maneuver. In large structures, for example, where a panel is stretched between a pair of arches, heavy mechanical equipment such as cranes must be used to install the panel in a reasonably tensioned state.

In actual practice, it is sufficiently difficult to erect frame supported fabric structures which are neat in appearance, that such structures are seldom used where aesthetic considerations are involved. Another problem with such structures is that when a highly tensioned state is achieved in the fabric to render the structure pleasing to the eye, they are highly vulnerable to the impact forces generated by wind gusts. The highly tensioned fabric panels are not able to deflect and absorb the impact loads and therefore these loads are transmitted directly to the supporting points causing damage to the frame or the ground anchors.

SUMMARY OF THE INVENTION

It is an object of the present invention to provide a fabric panel unit of improved construction which can be tensioned after installation. Another object is to provide such a unit which acts to absorb impact loading.

Another object is to provide such a unit in which the fabric tension can be increased or decreased when desired.

Another object is to provide such a unit which is simple, economical to manufacture and easy to use.

The foregoing objects are accomplished by providing a fabric panel unit for use between spaced structural elements comprising a fabric panel of a size to extend between the structural elements and adapted to be anchored to the structural elements, and an inflatable pocket arrangement formed in the panel so as to distend and to shorten the panel upon inflation.

BRIEF DESCRIPTION OF THE DRAWING

Preferred embodiments have been chosen for purposes of illustration and description, and are shown in the accompanying drawings, forming a part of the specification, wherein:

FIG. 9 is a partial perspective view of the interior of one end of a fabric covered frame structure showing a triangular panel unit in accordance with the present invention; and FIG. 10 is a perspective view of a trampoline comprising a panel unit according to the present invention secured to a rectangular frame.

DETAILED DESCRIPTION OF THE PREFERRED EMBODIMENTS

Figures 1, 2, 3:
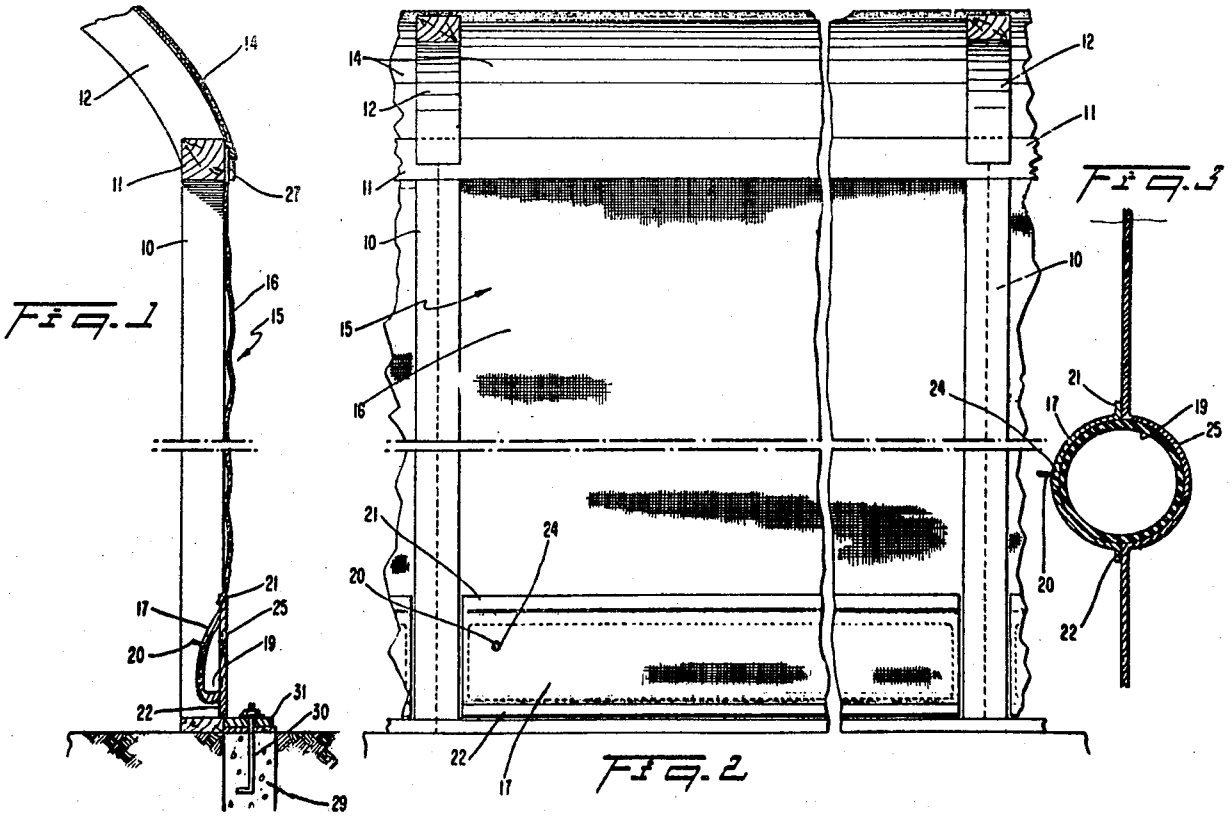
FIG. 1 is an elevational sectional view of a portion of a structure utilizing a fabric wall panel unit in accordance with the present invention.
FIG. 2 is an elevational view of the panel unit of FIG. 1 taken from inside the structure.
FIG. 3 is a cross-sectional view of the inflatable pocket in the panel unit of FIGS. 1 and 2 shown in the inflated condition.

Referring to FIGS. 1-4 in detail, there is shown a portion of a structure in which a framework including columns 10 and beams 11 (only one shown) support a solid roof consisting of arches 12 and a layer of roofing 14 overlying the arches. At least one side wall portion of this structure comprises a fabric panel unit 15 in accordance with the present invention. The unit 15 includes a fabric panel 16, a strip of fabric 17 extending horizontally along the base of the panel 16 and secured thereto to form a double layer of fabric with a pocket therebetween, and an inflatable tube 19 positioned in the pocket and provided with an inflation valve 20. The strip 17 is secured to the panel 16 along the upper and lower edge areas 21 and 22 of the strip to form an open-ended elongated horizontal pocket. The tube 19 is slid into the pocket from one end. A hole 24 is provided in the strip to provide access to the valve. The strip is dimensioned and positioned on the panel 16 so that when the tube 19 is inflated, the portion of the panel 25 lying between the edge areas 21 and 22 (FIGS. 3 and 4) becomes a significant portion of the circumference of the inflated pocket so that the edge areas 21 and 22 move together significantly upon inflation of the pocket and the panel 16 is shortened.

The term fabric as used throughout the specification and claims means any flexible sheet material including but not limited to sheet plastic, sheets woven of natural or synthetic fibers, and laminated sheets comprising a sheet of woven fibers coated on one or both sides by a layer of plastic. The strip 17 can be secured to the panel 16 by gluing, sewing, or heat-sealing according to the composition of the strip and the panel. When the panel unit is constructed of a fabric which is highly air-impermeable, the strip 17 can be sealed to the panel around its entire periphery so as to form an air-impermeable envelope. The valve unit is then positioned in the wall of the strip or the panel portion 25 and no separate inflatable tube is required.

In the embodiment of FIGS. 1–4, the top of the panel 16 is secured to the beam 11 by means of a strip 27 which is nailed, screwed or bolted to the beam so as to sandwich the edge of the panel 16 between the beam and the strip 27, the nails or screws or bolts passing through holes in the panel may be grommeted. The bottom edge of the panel 16 is anchored in similar manner to a concrete anchoring strip 29 having bolts 30 embedded therein. Holes in the lower edge of the panel are slid over the bolts 30 and a clamping strip 31 is bolted down onto the edge of the panel. The vertical edges of the panel 16 may be either attached or unattached to the columns 10.

As shown in FIG. 1, the panel unit is secured in place in a relatively slack condition. This allows the top and bottom edges of the panel unit to be positioned and anchored without the use of devices for drawing the panel taught while the edges are positioned and anchored in place.

After the panel unit is in place, the tube 19 is inflated and the pocket formed by the strip 17 and the panel portion 25 distends to assume a circular cross-section. As the panel portion 25 changes its shape from flat to semicircular, the panel 16 is shortened and is thereby tensioned. The tension in the panel can be adjusted by changing the pressure within the tube 19. Maximum tension in the panel is achieved by inflating the tube until the pocket is completely circular in cross-section. Lesser panel tension is achieved by only partially inflating the tube so that the panel tension holds the pocket in a vertically elongated cross-sectional configuration.

When wind gusts hit the panel, the inflated pocket acts to absorb the impact loading. The impact of the wind gusts creates a momentary surge in the fabric tension. A highly tensioned conventional fabric panel transmits the full impact loading to the anchorage points often resulting in the destruction of the anchoring system at its weakest point. In the panel unit of the present invention, impact loading causes the pocket to elongate as shown in FIG. 4 and therefore the shock forces are absorbed by the deformation of the pocket and do not over-stress the anchoring arrangement.

Figures 4, 5, 6, 7, 8:
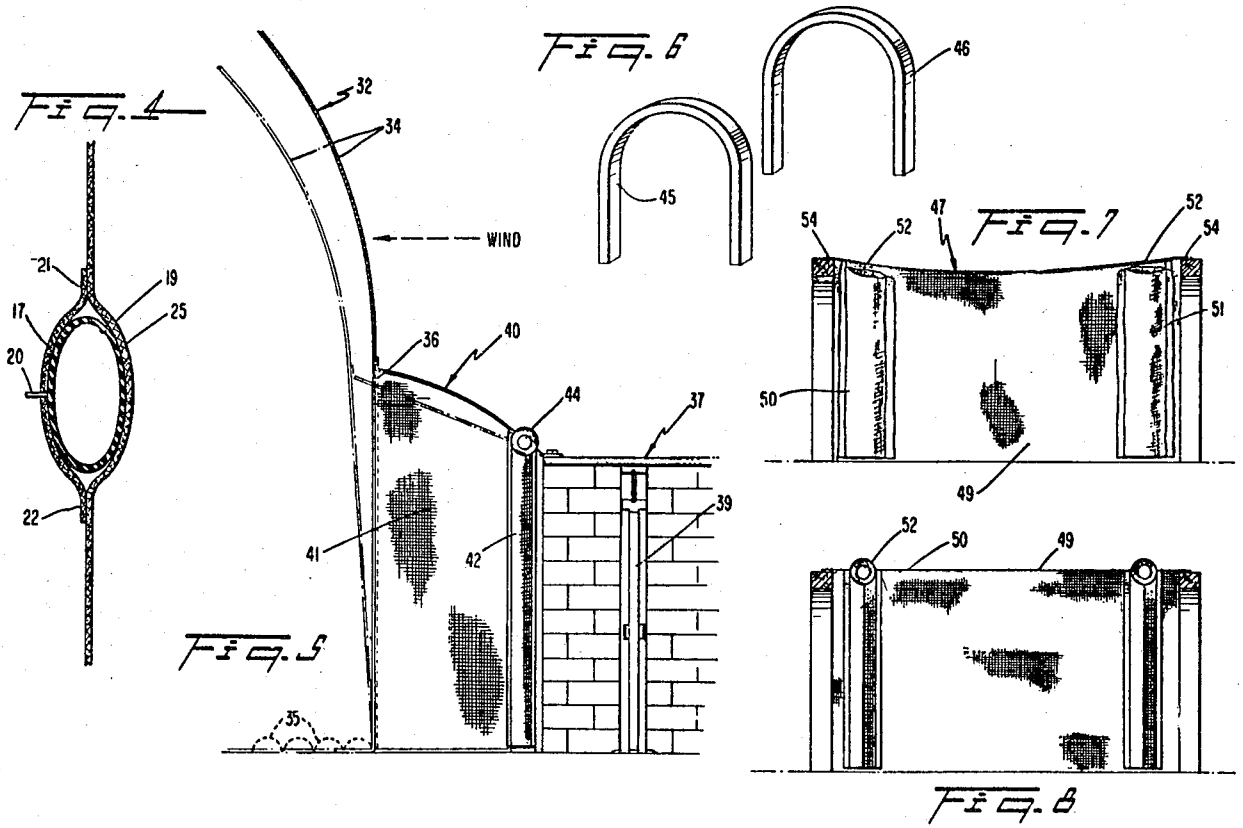
FIG. 4 is a cross-sectional view similar to FIG. 3 showing the shape assumed by the inflated pocket upon impact loading of the panel unit.
FIG. 5 is an elevational cross-sectional view of an entry arrangement for an inflated building including a panel unit in accordance with the present invention.
FIG. 6 is a perspective view of a pair of structural arches forming a portion of the framework to which fabric is to be secured to provide a structure.
FIG. 7 is an elevational longitudinal cross-sectional view of the arches of FIG. 6 showing a panel unit in accordance with the present invention secured to the arches in a slack condition.
FIG. 8 is a view similar to FIG. 7 showing the panel unit in a tensioned condition.

Referring now to FIG. 5, there is shown an entry arrangement for an inflatable building 32 which includes a fabric panel unit according to the present invention. The inflatable building 32 comprises a fabric envelope 34 which is anchored and sealed to the ground around its periphery and a blower unit (not shown) is employed to raise the air pressure within the building to above atmospheric pressure. The periphery of the building is anchored to the ground by means of a cable 35 sewn into the bottom edge of the building and connected to ground anchor bolts (not shown) spaced around the periphery of the building. An opening 46 is provided in the envelope 34 in line with an entry structure 37 which contains a door 39. An arched fabric panel unit 40 according to the present invention extends between the entry structure 37 and the envelope 34. The panel unit 40 includes a panel 41, a strip 42 secured to the panel to form a pocket, and an inflatable tube 44 positioned in the pocket. One end of the panel 41 is secured to the envelope 34 around the edge of the opening 36 and the other end is secured to the entry structure around its open end. The side edges of the panel 41 are anchored and sealed to the ground in accordance with standard practices in the inflatable building art. The strip 42 is oriented to run transversely to the axis of the line of entry to form a pocket which is arched throughout its length. The tube 44 is preferably molded in an arched shape so that there is no tendency for the tube to straighten out upon inflation. In this embodiment, the fabric panel unit 40 is permanently connected to the envelope 34 and the other end of the unit is connected to the structure 37 when the building is being installed (before the building is inflated). When the building is inflated, air pressurized to slightly above atmospheric pressure fills the envelope 34, and the entry arrangement up to the door 39 is filled as well. The tube is then inflated.

Inflated buildings are supported entirely by their internal pressure and are flexible in nature so that wind causes considerable movement in the fabric envelope. The entry structures containing the building's doors are, of necessity, rigidly anchored to the ground and do not flex with the building. It has been the standard practice in the construction of such buildings to provide a ballooned fabric panel forming an arch between the entry opening in the inflated envelope and the entry structure. Due to the considerable flexing of the inflated envelope as a result of wind loading, it has been necessary that this connecting panel have a width (dimension parallel to the line of entry) greatly in excess of the distance separating the opening and the entry structure during a no wind condition. The connecting panel therefore balloons outwardly to a considerable extent due to the internal pressure. It has been found that snow and ice at times adhere to and build up on the top of the connecting panel. The ballooned panel is under very light tension because the fabric assumes a curvature having a small radius. Therefore a snow or ice build up on a portion of the top of the panel causes the panel to sink at that spot, thus forming a depression. More snow, ice or rain can fill the depression and cause the entire top of the panel to sag downwardly, weighted down by the accumulated precipitation. A sufficient accumulation of precipitation can cause the panel to tear and small accumulations can cause destruction of the panel when strong winds are present.

The panel unit 40 of the present invention is not subject to these problems. The panel 41 is dimensioned to provide a flat curve between the envelope and the entry structure so that the tension in the panel is high and deflection under snow and ice loading is resisted. The panel 41 is protected against the destructive effect of wind loading by the shock-absorbing qualities of the inflated pocket of the panel unit 40. After the building is inflated, the tension in the panel 41 and the magnitude of the impact loads which will be absorbed by the unit 40 are adjusted by the pressure to which the tube 44 is inflated. When the tube is inflated to a low pressure, the lighter impact loads will be absorbed but the greater part of the shock of the heavier impact loads will be transmitted. Conversely, when the tube is inflated to a low pressure, the lighter impact loads will not deform the pocket and will be transmitted while the shock of the heavier loads will be absorbed.

Referring now to FIGS. 6 to 8, there is shown a portion of a structure in which a pair of arches 45 and 46 are erected in parallel relation to each other. The arches are anchored to foundations (not shown) which are sunk into the ground at the base of each end of each arch. As shown in FIG. 7, a panel unit 47 is attached to the arches 45 and 46 in a slack condition. The unit 47 includes a panel 49, a pair of fabric strips 50 and 51 attached to the inner surface of the panel adjacent to the arches 45 and 46, respectively, and parallel thereto, and a pair of inflated tubes 52 positioned in the pockets formed by the strips 50 and 51. The panel 49 is secured to the arches by any convenient anchoring arrangement, for example, by bolts 54 which pass through grommeted holes in the edges of the panel into threaded bores provided at the outer surface of the arches. The tubes 52 are formed to take on a curved shape when inflated so that they have no tendency to straighten upon inflation.

The unit 47 is relatively easy to secure to the arches since it can be installed in a slack condition. After the unit is completely secured to the arches, the tubes 52 are inflated, and the panel is thus shortened in the direction transverse to the pockets and thereby tensioned in that direction.

In FIG. 9 there is shown a portion of a structure which comprises a tubular metal frame and a fabric envelope supported by the frame. The frame includes a pair of end tubes 55 extending from the ground upwardly at an angle toward each other to a connector 56. A ridge tube 57 extends horizontally from the connector 56 toward the other end of the structure. The fabric envelope includes a floor panel 59, two roof panels 60 and 61, and an end panel 62. The panels are interconnected along their edges and the envelope is anchored to the frame by loops 64 which are fastened to the junction lines between the panels 60, 61 and 62. Loops 64 are also provided along edges of the panel 59 for connection to ground anchor pins 65.

The triangular end panel 62 is part of a fabric panel unit according to the present invention which also includes three fabric strips 66, 67 and 68 extending around the periphery of the panel 62. The ends of the strips are interconnected to form a continuous tunnel extending around the edge of the panel 62. Within this tunnel is positioned a triangular continuous tube (not shown) formed from three straight tube sections having mitered ends, the tube sections being sealed together at the mitered ends. In this embodiment, the tube is positioned against the surface of the panel 62 (in deflated condition) and the strips 66–68 are laid over each leg of the tube and sealed to the panel encapsulated by the tube within the pocket thus formed. A valve 70 is provided in one leg of the tube at a convenient location and extends through an opening in the covering strip.

The structure is attached to the frame members and to the ground anchor pins with the triangular tube in the deflated condition. The tube is then inflated to distend the pocket in which it is contained and to shorten the panel 62 in the direction transverse to each of the legs of the pocket defined by the strips 66, 67 and 68. The panel 62 is thus tensioned in all directions to an extent controlled by the pressure within the tube.

FIG. 10 shows a fabric panel unit 72 according to the present invention which is mounted on a rectangular horizontal frame 74 to provide a trampoline. The frame 74 is formed from four wooden planks 75 stood on edge and provided with mitered corners. The panel unit 72 includes a fabric panel 76 which extends between the planks 75. Each edge of the panel 76 is secured to one of the planks 75 by means of a clamping strip 77 and screws 79. A fabric strip 80 is secured to the panel 76 along each edge inwardly of the inner edge of the plank 75 to form a pocket. A tube 81 is positioned in each of the pockets formed between the strips and the panel. Each tube has its own inflation valve 82. The fabric panel 76 is secured to the frame 74 when the tubes are deflated. The tubes are thereafter inflated to produce the desired tension in the panel 76. The tension in the panel lengthwise and widthwise can be controlled separately and set at different values if desired. The presence of a pocket at each edge of the panel acts as a safety border to help prevent contact with the supporting frame.

It will be appreciated that the present invention can be utilized in numerous other ways not shown or described herein and many variations of construction and arrangement are possible within the scope of the present invention.

It will be seen that the present invention fully accomplishes the objects set forth herein above.

I claim:

1. A fabric panel unit comprising in combination two arch shaped spaced structural elements, a fabric panel extending between the structural elements in a relatively slack condition and secured to the structural elements, said panel including at least a first portion having an edge connected to one of said structural elements and a second portion having an edge connected to another of said structural elements, said first and second portions extending from their connected edges toward each other, and pocket means being elongated and formed in said panel between said first and second portions, said pocket means including first and second layers of fabric joined together along opposite edges thereof to form a pocket, said first layer comprising a portion of the fabric panel which extends between the structural elements means providing an air impervious inflatable gas envelope in said pocket, said first and second fabric layers being of substantially similar dimensions and both being unconstrained except at said edges, said first layer forming at least about half of the active surface area of the pocket so that when said envelope is inflated with gas said pocket distends by the deformation of both said first and second fabric layers, with the deformation of said first layer acting to shorten said panel and remove slack therein, said pocket being elongated and extending along said fabric panel in a direction transverse to the desired tension forces and extending generally parallel to said arches and positioned with respect to said structural elements so that upon inflation the tension in the panel lies along a line which substantially bisects the distended pocket, whereby a frame and fabric structure can be easily erected in a slack condition and subsequently be tensioned by inflating said envelope.

2. A fabric panel unit for use with a rigid entry structure of an inflated building comprising in combination an arched shaped fabric panel having one end attached to the wall of the inflated building and the other end to said rigid entry structure, elongated pocket means formed in said panel and extending along the arch of said panel generally transverse to a line extending from said entry structure to said opening in the wall of the inflated building, said pocket means including first and second layers of fabric joined together along opposite edges thereof to form a pocket, means providing an air impervious gas envelope in said pocket, said first and second fabric layers being of substantially similar dimensions so that when said envelope is inflated with gas said pocket means distends to shorten and tension said panel and acts as a wind absorber when the wind loads force the inflatable building away from said entry structure, said pocket means extending along said fabric panel in a direction generally transverse to the desired tension forces.

* * * * *